US011913452B2

(12) United States Patent
Inoue et al.

(10) Patent No.: US 11,913,452 B2
(45) Date of Patent: Feb. 27, 2024

(54) SCREW COMPRESSOR

(71) Applicant: DAIKIN INDUSTRIES, LTD., Osaka (JP)

(72) Inventors: Takashi Inoue, Osaka (JP); Hideyuki Gotou, Osaka (JP); Hiromichi Ueno, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 342 days.

(21) Appl. No.: 17/502,813

(22) Filed: Oct. 15, 2021

(65) Prior Publication Data

US 2022/0034319 A1 Feb. 3, 2022

Related U.S. Application Data

(63) Continuation of application No. PCT/JP2020/005106, filed on Feb. 10, 2020.

(30) Foreign Application Priority Data

Apr. 19, 2019 (JP) ..... 2019-080518

(51) Int. Cl.
*F04C 18/52* (2006.01)
*F04C 18/16* (2006.01)
(Continued)

(52) U.S. Cl.
CPC ..... *F04C 18/52* (2013.01); *F04C 18/16* (2013.01); *F04C 28/08* (2013.01); *F25B 49/025* (2013.01);
(Continued)

(58) Field of Classification Search
CPC ..... F04C 18/52; F04C 18/16; F04C 18/084; F04C 28/08; F25B 49/025; F25B 2600/021; F25B 2600/025
See application file for complete search history.

(56) References Cited

U.S. PATENT DOCUMENTS

| | | | |
|---|---|---|---|
| 4,900,239 | A | 2/1990 | Zimmern |
| 2005/0188708 | A1 | 9/2005 | Wills et al. |
| 2012/0258005 | A1 | 10/2012 | Hossain et al. |

FOREIGN PATENT DOCUMENTS

| | | | |
|---|---|---|---|
| CN | 2787880 | Y | 6/2006 |
| CN | 108644116 | A | 10/2018 |

(Continued)

OTHER PUBLICATIONS

International Search Report of corresponding PCT Application No. PCT/JP2020/005106 dated Apr. 7, 2020.

(Continued)

*Primary Examiner* — Emmanuel E Duke
(74) *Attorney, Agent, or Firm* — Global IP Counselors, LLP

(57) ABSTRACT

A screw compressor includes a screw rotor, a gate rotor, and a speed adjuster. The screw rotor has an outer peripheral surface with a plurality of screw grooves. The screw rotor is configured to be rotated. The gate rotor has a plurality of teeth. A ratio T/S of a number T of the teeth to a total number S of the screw grooves is greater than or equal to 2.5. The gate rotor meshes with the screw rotor. The speed adjuster is configured to adjust a rotational speed of the screw rotor. Rotation of the screw rotor at an angle greater than 180° allows the screw compressor to perform a stroke from start of compression to completion of discharge.

17 Claims, 10 Drawing Sheets

(51) Int. Cl.
*F04C 28/08* (2006.01)
*F25B 49/02* (2006.01)

(52) U.S. Cl.
CPC ... *F25B 2600/021* (2013.01); *F25B 2600/025* (2013.01)

(56) References Cited

FOREIGN PATENT DOCUMENTS

| | | | | | |
|---|---|---|---|---|---|
| EP | 3 617 513 | A1 | | 3/2020 | |
| JP | 2-5778 | A | | 1/1990 | |
| JP | 6-42475 | A | | 2/1994 | |
| JP | 2007-525616 | A | | 9/2007 | |
| JP | 2011-196223 | A | | 10/2011 | |
| JP | 2012097644 | A | * | 5/2012 | |
| JP | 2012097645 | A | * | 5/2012 | |
| WO | 2011/077724 | A1 | | 6/2011 | |
| WO | 2015/193974 | A1 | | 12/2015 | |
| WO | WO-2015193974 | A1 | * | 12/2015 | ..... F04C 18/52 |
| WO | 2018/003015 | A1 | | 1/2018 | |
| WO | WO-2018003015 | A1 | * | 1/2018 | ..... F04C 18/52 |
| WO | 2018/198202 | A1 | | 11/2018 | |

OTHER PUBLICATIONS

European Search Report of corresponding EP Application No. 20 79 2153.7 dated Apr. 12, 2022.
International Preliminary Report of corresponding PCT Application No. PCT/JP2020/005106 dated Oct. 28, 2021.

* cited by examiner

IPLV=0.01 × A+0.42 × B+0.45 × C+0.12 × D

A = COP AT 100% LOAD
B = COP AT 75% LOAD
C = COP AT 50% LOAD
D = COP AT 25% LOAD (r/s)

| MAXIMUM ROTATIONAL SPEED (100% LOAD) | 150 | 120 | 90 | 60 |
|---|---|---|---|---|
| 75% LOAD | 90 | 72 | 54 | 36 |
| 50% LOAD | 50 | 40 | 30 | 20 |
| 25% LOAD | 24 | 19 | 14 | 10 |

SCREW COMPRESSOR

CROSS-REFERENCE TO RELATED APPLICATIONS

This is a continuation of International Application No. PCT/JP2020/005106 filed on Feb. 10, 2020, which claims priority to Japanese Patent Application No. 2019-080518, filed on Apr. 19, 2019. The entire disclosures of these applications are incorporated by reference herein.

BACKGROUND

Field of Invention

The present disclosure relates to a screw compressor.

Background Information

Some of screw compressors include a gate rotor meshing with a screw rotor, which rotates at an angle greater than 180° so that a stroke is performed from the start of compression to completion of discharge (see, for example, Japanese Unexamined Patent Publication No. H06-42475).

This type of screw compressor further includes an electric motor rotating the screw rotor at a fixed rotational speed. The capacity (displacement per unit time) of this type of screw compressor is controlled by unloading such that a portion of a working fluid (a refrigerant) that is being compressed is returned to the suction side of the screw compressor.

SUMMARY

A first aspect of the present disclosure is directed to a screw compressor including a screw rotor, a gate rotor, and a speed adjuster. The screw rotor has an outer peripheral surface with a plurality of screw grooves. The screw rotor is configured to be rotated. The gate rotor has a plurality of teeth. A ratio T/S of a number T of the teeth to a total number S of the screw grooves is greater than or equal to 2.5. The gate rotor meshes with the screw rotor. The speed adjuster is configured to adjust a rotational speed of the screw rotor. Rotation of the screw rotor at an angle greater than 180° allows the screw compressor to perform a stroke from start of compression to completion of discharge.

DETAILED DESCRIPTION OF EMBODIMENT(S)

First Embodiment

An embodiment will now be described in detail with reference to the drawings.

Schematic Configuration

Figure 1:
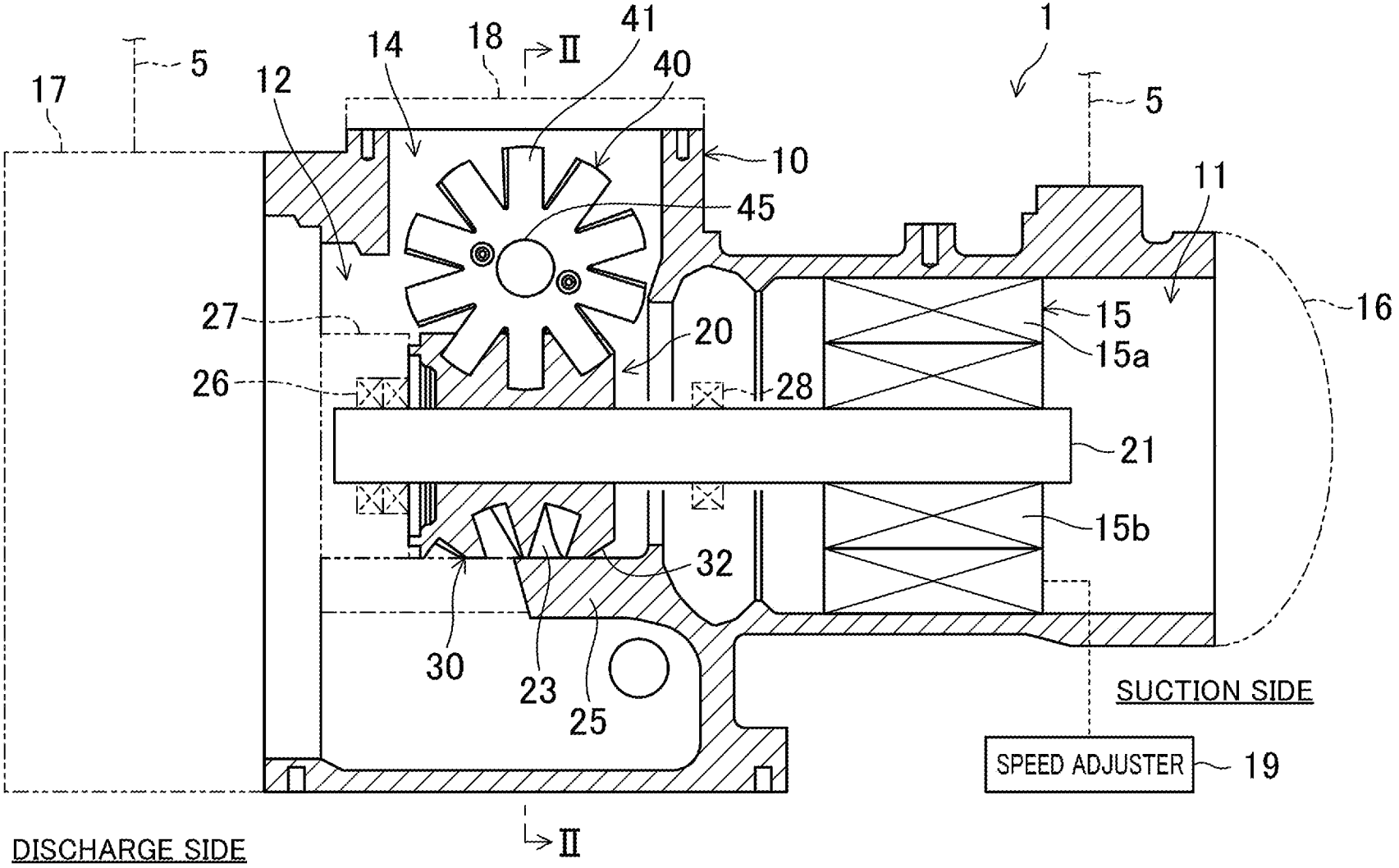
FIG. 1 is a vertical cross-sectional view of a screw compressor according to an embodiment (a cross-sectional view taken along line I-I shown in FIG. 2).
Figure 2:
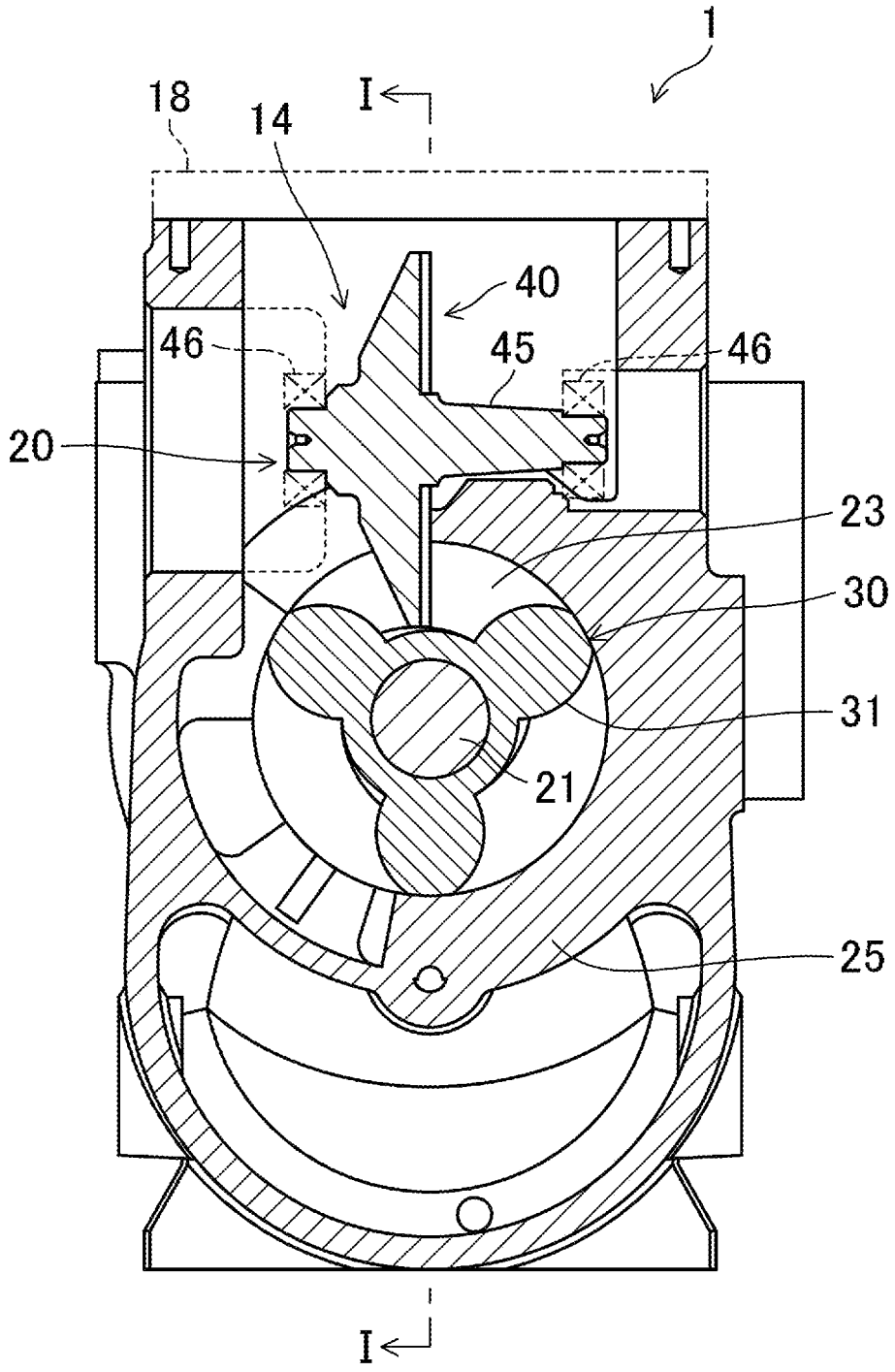
FIG. 2 is a cross-sectional view taken along line II-II shown in FIG. 1.

A screw compressor (1) of this embodiment, shown in FIGS. 1 and 2, is used for refrigerating and air conditioning. The screw compressor (1) is provided to a refrigerant circuit (5) performing a refrigeration cycle, and compresses a refrigerant serving as a working fluid. The screw compressor (1) includes a hollow casing (10) and a compression mechanism (20).

FIG. 1 shows only a portion of the refrigerant circuit (5). This refrigerant circuit (5) is filled with a refrigerant with a lower density than a refrigerant HFC-134a (1, 1, 1, 2-tetrafluoroethane). Specifically, this refrigerant circuit (5) is filled with a refrigerant R1234ze.

The material of the refrigerant R1234ze is HFO-1234ze (E- or Z-1, 3, 3, 3-tetrafluoropropene). Casing A substantially central portion of the interior of the casing (10) houses the compression mechanism (20) configured to compress a low-pressure refrigerant. The interior of the casing (10) is partitioned into a low-pressure chamber (11) and a high-pressure chamber (12). The low-pressure chamber (11) is a space into which a low-pressure gas refrigerant is introduced from an evaporator (not shown) of the refrigerant circuit (5) and which guides the low-pressure gas to the compression mechanism (20). The high-pressure chamber (12) is a space into which a high-pressure gas refrigerant that has been discharged from the compression mechanism (20) flows.

A suction cover (16) is fitted to an end face of the casing (10) near the low-pressure chamber (11), and a discharge cover (17) is fitted to an end face of the casing (10) near the high-pressure chamber (12). A gate rotor chamber (14) of the casing (10), which will be described below, is covered with a gate rotor cover (18).

Electric Motor

An electric motor (15) is fixed inside the casing (10). The electric motor (15) includes a stator (15*a*), and a rotor (15*b*) rotating in the stator (15*a*). The electric motor (15) and the compression mechanism (20) are connected together through a drive shaft (21) serving as a shaft. A bearing holder (27) is provided in the casing (10). The drive shaft (21) has a discharge-side end portion supported by bearings (26) fitted to the bearing holder (27). The drive shaft (21) has an intermediate portion supported by a bearing (28).

In this embodiment, a speed adjuster (19) configured to adjust the rotational speed of the electric motor (15) is connected to the electric motor (15). The speed adjuster (19) of this embodiment is an inverter circuit that changes the frequency of an alternating current (AC) power supply to vary the rotational speed of the electric motor (15). The inverter circuit (19) varying the rotational speed of the electric motor (15) causes the rotational speed of one screw rotor (30), which will be described below, connected through the drive shaft (21) to the electric motor (15) to also vary.

Compression Mechanism

The compression mechanism (20) includes a cylindrical wall (25), the one screw rotor (30), and one gate rotor (40). The cylindrical wall (25) is formed inside the casing (10). The screw rotor (30) is disposed inside the cylindrical wall (25). The gate rotor (40) meshes with the screw rotor (30). The screw rotor (30) is fitted to the drive shaft (21), and is prevented from rotating around the drive shaft (21) by a key (not shown). The screw compressor (1) of this embodiment is a so-called single-screw compressor with one gate rotor. This single-screw compressor includes the screw rotor (30) and the gate rotor (40), which are provided as a pair of rotors within the casing (10) as described above.

The cylindrical wall (25) with a predetermined thickness is formed in a central portion of the casing (10). The screw rotor (25) is rotatably inserted into this cylindrical wall (25). The cylindrical wall (25) has one surface (right end in FIG. 1) facing the low-pressure chamber (11). The cylindrical wall (25) has the other surface (left end in FIG. 1) facing the high-pressure chamber (12).

Figure 4:
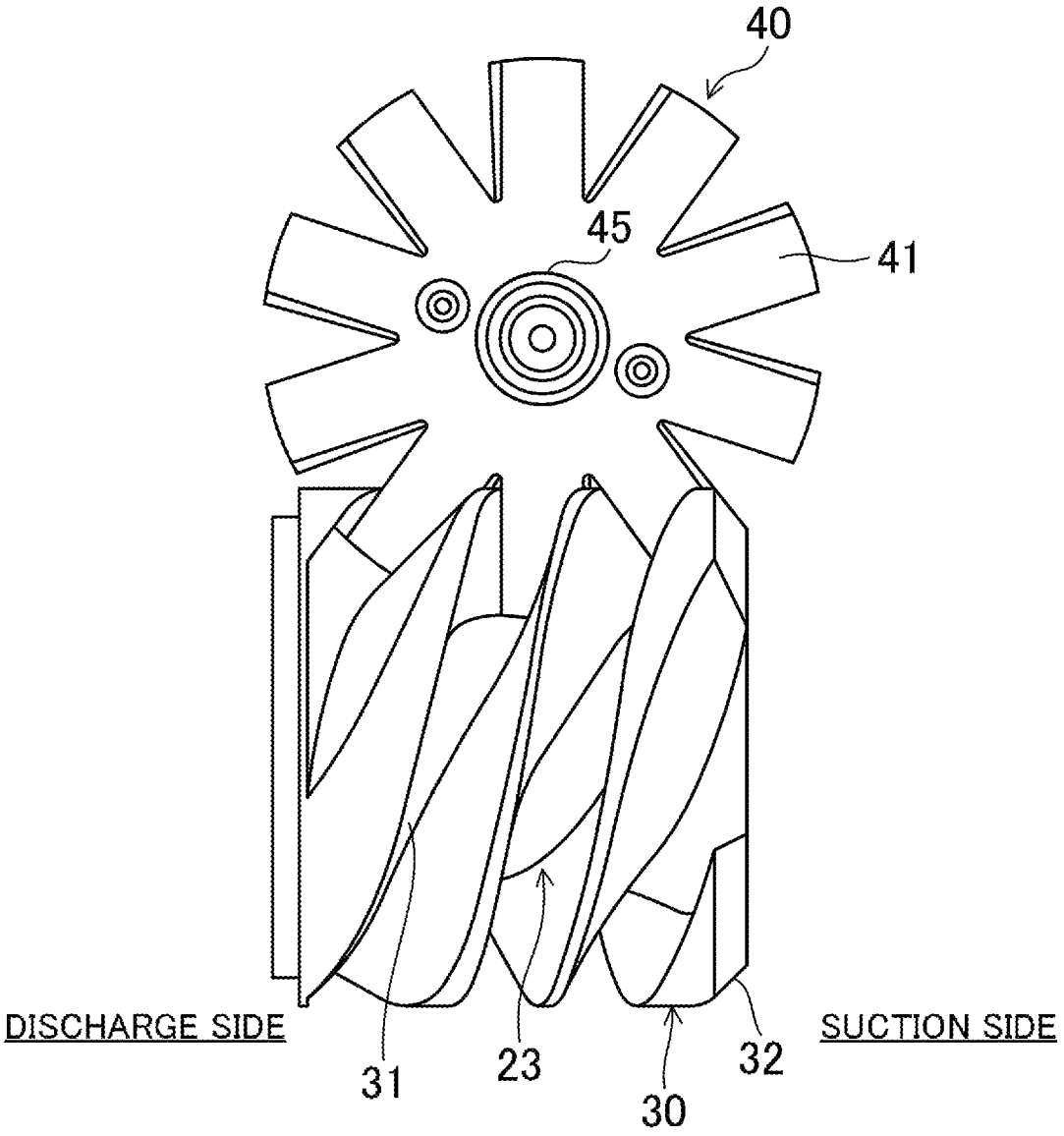
FIG. 4 shows the external appearances of a screw rotor and a gate rotor meshing with each other.
Figure 5:
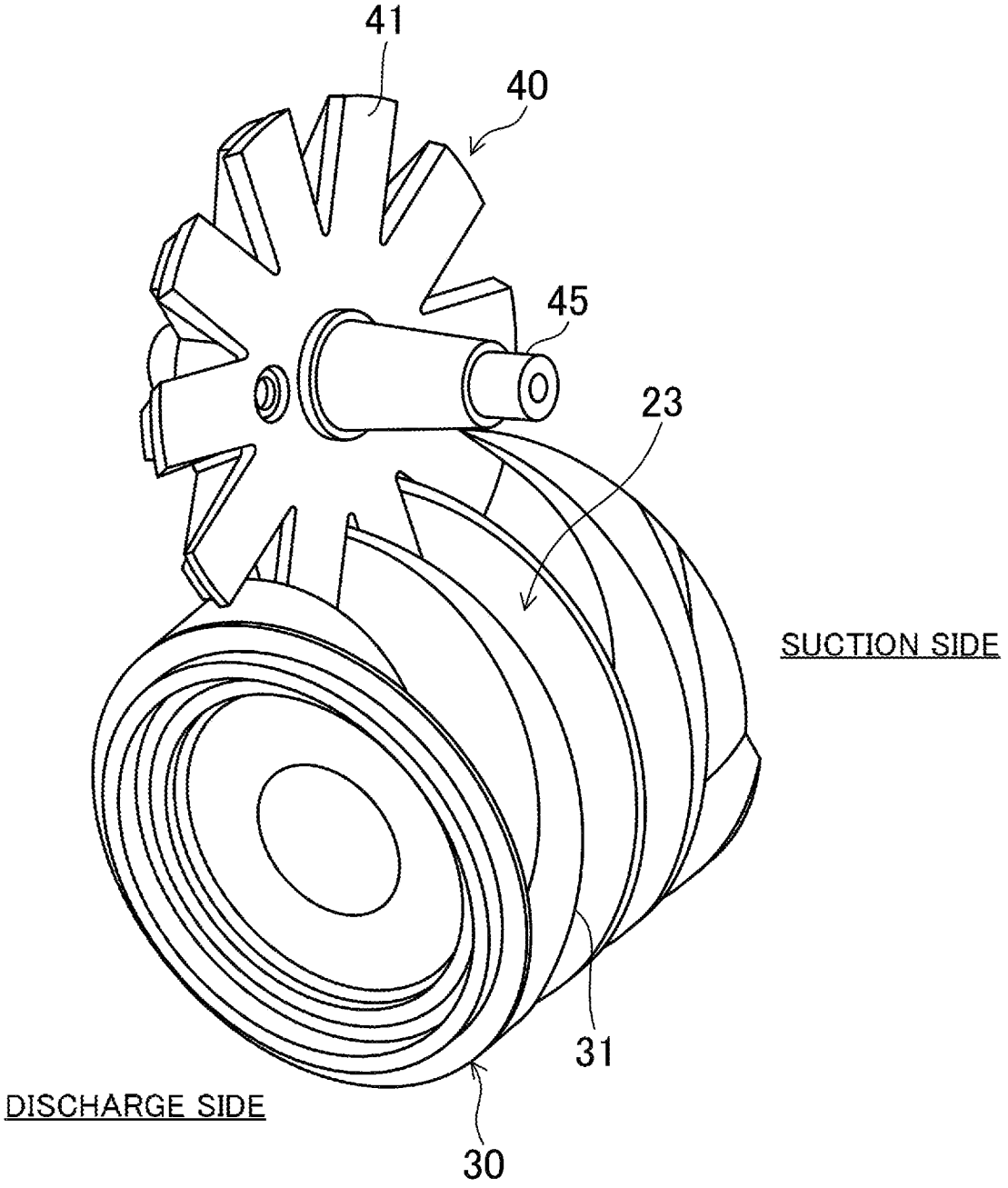
FIG. 5 is a perspective view of the screw rotor and the gate rotor meshing with each other.

As illustrated in FIGS. 4 and 5, a plurality of (three in this embodiment) helical screw grooves (31) are formed on the outer peripheral surface of the screw rotor (30). The screw rotor (30) is rotatably fitted to the cylindrical wall (25), and is rotated by the electric motor (15). The outer surface of the blade tip of the screw rotor (30) is surrounded by the cylindrical wall (25).

The gate rotor (40) is formed into the shape of a disk including a plurality of gates (teeth) (41) (ten gates in this first embodiment) arranged radially. The gate rotor (40) has an axis that lies on a plane perpendicular to the axis of the screw rotor (30). The gate rotor (40) is configured such that some of its gates (41) pass through a portion of the cylindrical wall (25) to respectively mesh with the screw grooves (31) of the screw rotor (30). The screw rotor (30) is made of metal, and the gate rotor (40) is made of a synthetic resin.

The ratio T/S of the number T of the gates (41) (teeth) of the gate rotor (40) of the screw compressor (1) of the present disclosure to the total number S of the screw grooves (31) is greater than or equal to 2.5. Rotation of the screw rotor (30) at an angle greater than 180° allows the screw compressor (1) of the present disclosure to perform a stroke from the start of compression to completion of discharge. Rotation of the screw rotor (30) at an angle of about 360° allows, in particular, the screw compressor (1) of this embodiment to perform a stroke from the start of compression to completion of discharge.

The gate rotor (40) is disposed in the gate rotor chamber (14) defined in the casing (10). The gate rotor (40) has a central portion connected to a driven shaft (45) serving as a shaft. The driven shaft (45) is rotatably supported by a bearing (46) provided in the gate rotor chamber (14). The bearing (46) is held in the casing (10) via a bearing housing.

In the compression mechanism (20), a space surrounded by the inner peripheral surface of the cylindrical wall (25) and the screw grooves (31) of the screw rotor (30) forms a fluid chamber (23) that changes into a suction chamber or a compression chamber. In both of a situation where the chamber (23) is referred to as the "compression chamber" and a situation where the chamber (23) is referred to as the "fluid chamber," the reference character "(23)" is hereinafter used. A right end portion of the screw rotor (30) shown in FIGS. 1, 4, and 5 is close to the suction side thereof, and a left end portion thereof is close to the discharge side thereof. An outer peripheral portion of a suction-side end portion (32) of the screw rotor (30) is tapered. Each screw groove (31) of the screw rotor (30) opens, at its suction-side end portion (32), to the low-pressure chamber (11), and this open portion functions as a suction port of the compression mechanism (20).

In the compression mechanism (20), the rotation of the screw rotor (30) causes the gates (41) of the gate rotor (40) to move with respect to the associated screw grooves (31) of the screw rotor (30). Thus, the compression chamber (23) is repeatedly expanded and contracted. Thus, a suction stroke, a compression stroke, and a discharge stroke for a refrigerant are sequentially and repeatedly performed.

Slide Valve

Figure 3:
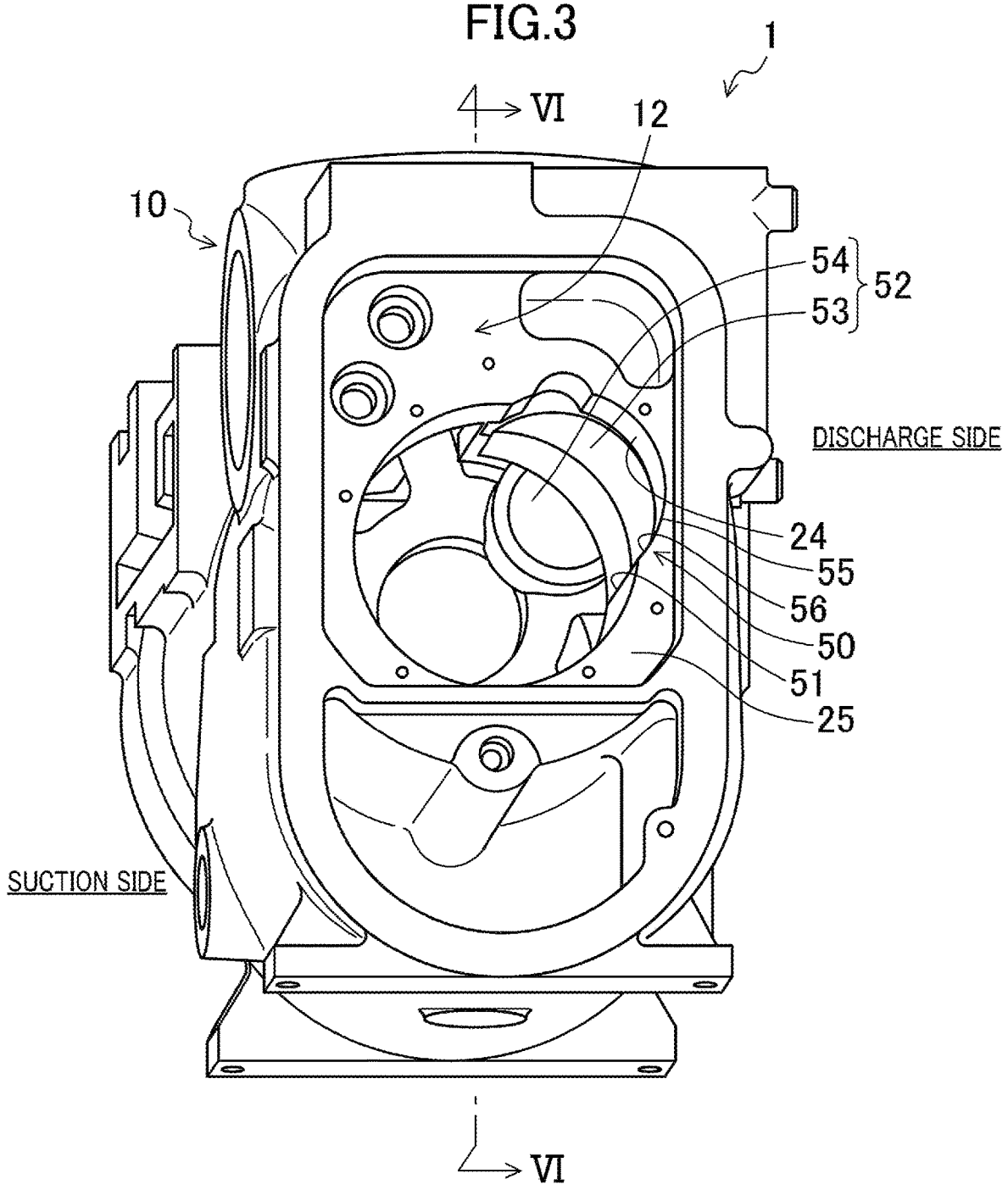
FIG. 3 is a perspective view of a casing of the screw compressor shown in FIG. 1 as viewed from a discharge-side end face of the casing.
Figure 6:
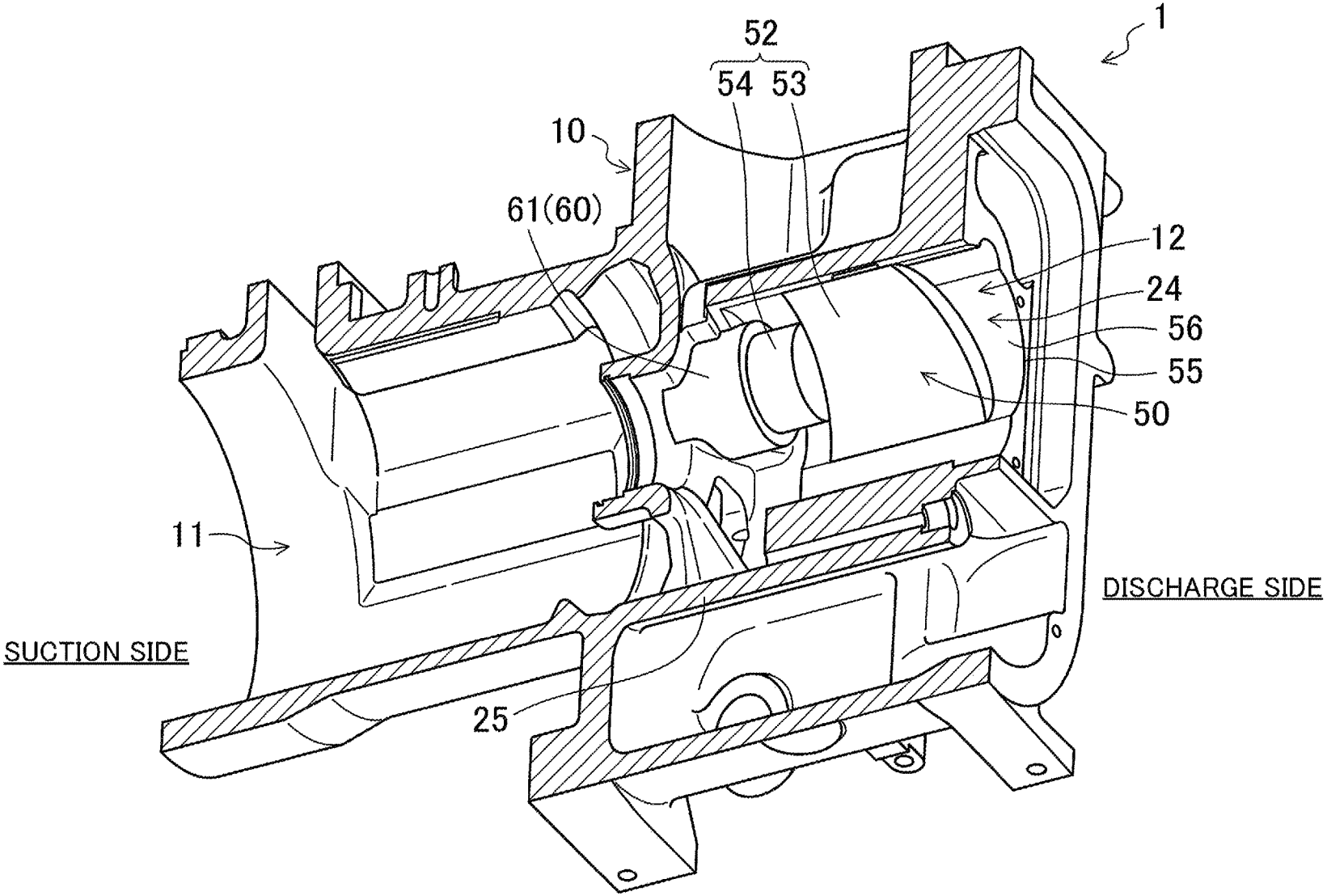
FIG. 6 is a perspective view of the cross section taken along line VI-VI shown in FIG. 3.
Figure 7:
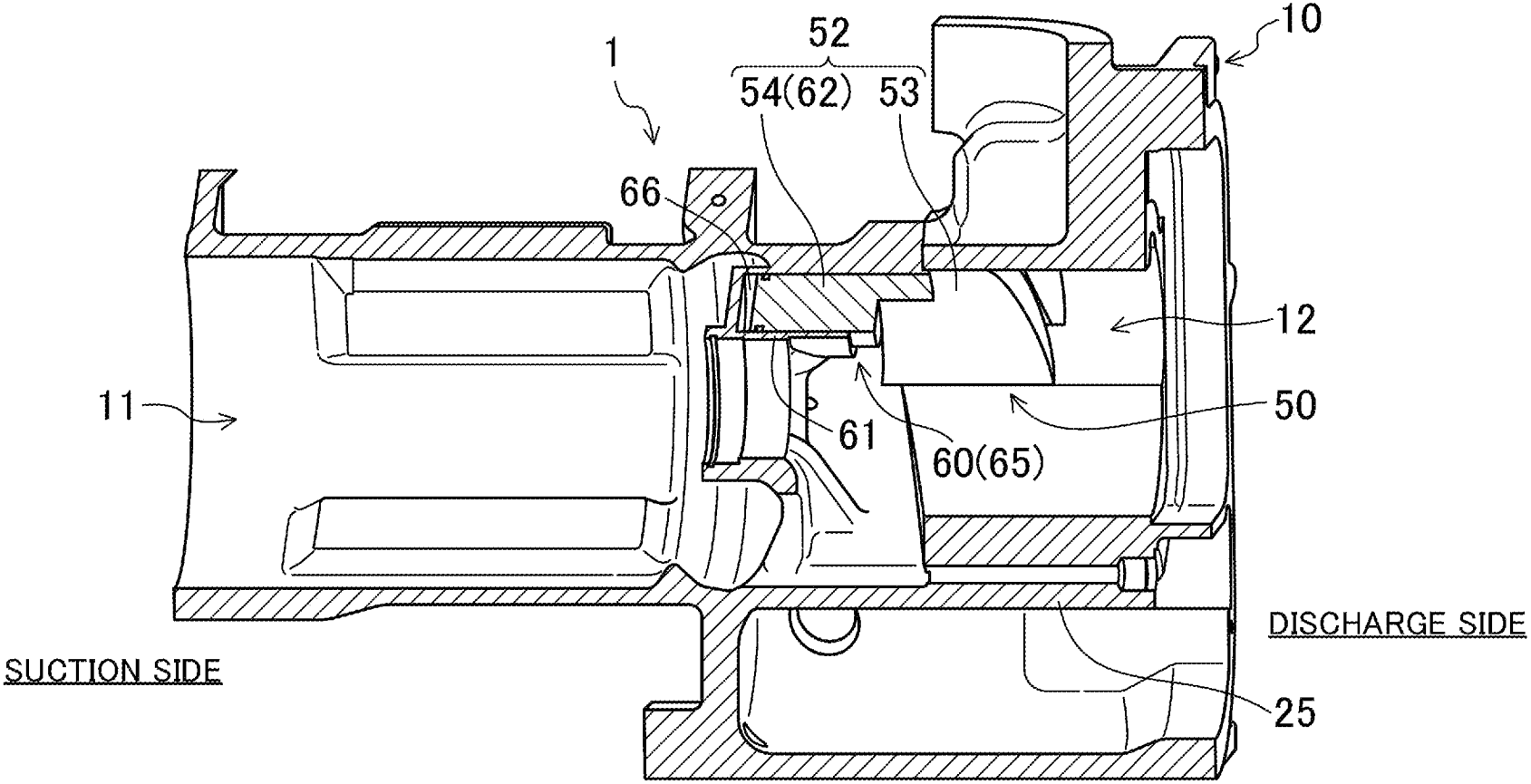
FIG. 7 is a sectional view of the casing taken along a plane passing through the center of a slide valve.

As shown in FIG. 3, which is a perspective view of the casing (10) as viewed from the discharge side thereof, and FIG. 6, which is a cross-sectional view taken along plane VI-VI of FIG. 3, the screw compressor (1) includes a valve adjusting mechanism (50) including a slide valve (52). The slide valve (52) is configured to adjust the timing when the fluid chamber (23) serving as the compression chamber communicates with a discharge port (24) to control the internal volume ratio (the ratio of the discharge volume to the suction volume of the compression mechanism (20)). FIG. 7 illustrates a sectional view of the casing taken along a plane passing through the center of the slide valve (52).

In this embodiment, the valve adjusting mechanism (50) is provided at one portion of the casing (10) as illustrated in FIGS. 3, 6, and 7. The valve adjusting mechanism (50) adjusts the opening area of an opening (51) of the cylindrical wall (25) to communicate with the compression chamber (23) defined by the gates (41) meshing with the screw grooves (31). The opening (51) is a discharge port of the compression mechanism (20) of this embodiment.

Figure 8:
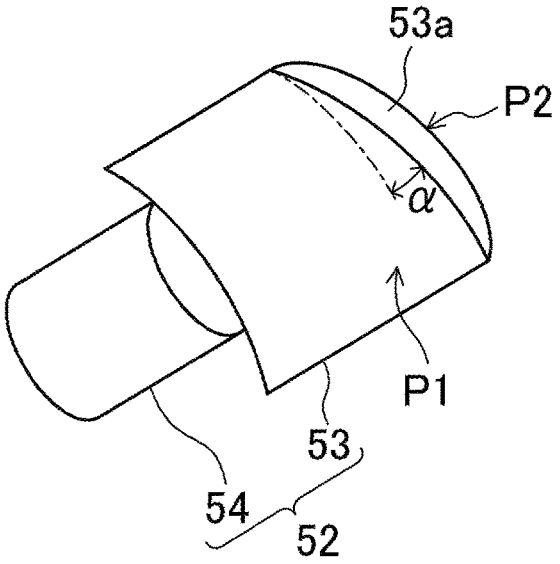
FIG. 8 is a perspective view illustrating the external shape of the slide valve.

The slide valve (52) includes a valve body (53) and a guide portion (54). As illustrated in FIG. 8, which is a perspective view illustrating the external shape of the slide valve (52), the slide valve (52) is a member including the valve body (53) having a gently arc-shaped sectional shape, and the guide portion (54) having a circular cylindrical shape. The valve body (53) and the guide portion (54) are integrated together. An arc-shaped surface of the valve body (53) corresponding to an inner peripheral surface (P1) thereof has a greater radius than the other arc-shaped surface thereof near an outer peripheral surface (P2) thereof does.

The casing (10) has a cylinder (61) into which the guide portion (54) is slidaby fitted in the axial direction of the guide portion (54). The valve body (53) slides in the axial direction to adjust the opening area of the opening (51). The casing (10) has a valve housing portion (55) that slidably houses the valve body (53) in the axial direction. The valve housing portion (55) is a recess extending parallel to the axial direction of the cylindrical wall (25) of the casing (10). A portion of the valve housing portion (55) facing the screw rotor (30) has an opening, which serves as the opening (51). The valve housing portion (55) has a curved wall (56) protruding radially outward of the screw rotor (30) from the cylindrical wall (25) to have an arc-shaped cross section and extending in the axial direction of the screw rotor (30).

The valve adjusting mechanism (50) allows the valve body (53) to move in the axial direction, while restricting the motion of the valve body (53) in a direction perpendicular to the axial direction (the radial direction of the screw rotor (30)).

The valve body (53) has a high pressure end face (53*a*) facing a channel through which a high-pressure fluid compressed in the compression chamber (23) flows into a discharge passage (not shown) in the casing (10) (see FIG. 8). In FIG. 8, the degree of inclination (a) of the high pressure end face (53*a*) with respect to the line perpendicular to the axis of the valve body (53) is determined to be substantially equal to the degree of inclination of the screw grooves (31).

As described above, the screw rotor (30) inserted into the cylindrical wall (25) allows the casing (10) to have therein the fluid chamber (23). The cylindrical wall (25) has two ends respectively close to the suction side and discharge side of the fluid chamber (23). As illustrated in FIG. 7, the guide portion (54) is closer to the suction side of the fluid chamber than the valve body (53) is.

Slide Valve Driving Mechanism

As can be seen from the schematic configuration shown in FIG. 7, the screw compressor (1) includes a slide valve driving mechanism (60) configured to drive the slide valve (52). The slide valve driving mechanism (60) is configured as a hydropneumatic cylinder mechanism (65) including the cylinder (61) integrated with the casing (10), and a piston (62) housed in the cylinder (61) to move forward and backward through the cylinder (61).

The piston (62) of the hydropneumatic cylinder mechanism (65) is the guide portion (54). Although not described in detail, the slide valve driving mechanism (60) is configured to move the piston (62) and in turn the slide valve (52) from the suction side to the discharge side using the difference between a driving force toward the low-pressure chamber produced by a high pressure acting on the area of the high pressure end face (53*a*) of the valve body (53) and a driving force toward the high-pressure chamber produced by the high pressure of the fluid which is introduced into the cylinder chamber (66) between the cylinder (61) and the piston (62) which acts on the piston (62). Thus, the area of an end face of the piston (62) is set to be larger than the area of the high pressure end face (53*a*).

Adjusting the position of the slide valve (52) allows the position of the high pressure end face (53*a*) facing the channel through which the high-pressure refrigerant compressed in the compression chamber (23) flows into the discharge passage in the casing (10) to change. This causes the opening area of the opening (51) serving as the discharge port formed on the cylindrical wall (25) of the casing (10) to change. Thus, the timing when the screw groove (31) communicates with the discharge port during the rotation of the screw rotor (30) changes. This allows the internal volume ratio of the compression mechanism (20) to be adjusted.

In this embodiment, the position of the slide valve (52) is controlled to optimize the discharge timing in accordance with the operating state. Thus, the refrigerant having a pressure suitable for the operating state is discharged from the screw compressor (1) to the refrigerant circuit (5). This improves the operating efficiency of the refrigerant circuit.

The internal volume ratio VR of the slide valve (52) can be successively changed within the range $1.2 \leq VR \leq 5$ so as to be set at an optimum point, or can be gradually divided into several steps so as to be set at the optimum point (a substantially optimum point). The lower limit of the internal volume ratio range, i.e., VR=1.2, is determined based on the stroke limit of a general slide valve, and the upper limit thereof, i.e., VR=5, is determined based on the compression ratio (maximum compression ratio) high enough to make ice. However, these values may be changed to other values.

Control of Rotational Speed of Screw Rotor

The screw compressor (1) of this embodiment is configured such that the inverter (19) serving as the speed adjuster controls the electric motor (15) to allow the maximum rotational speed of the electric motor (15) at rated output (at 100% load) to be higher than 3000 (r/min). The reason why the rotational speed is set as described above is as follows.

The rotational speed n of the AC electric motor (15) is represented by $n=(120f)/p$, where n (r/min) represents the rotational speed, f (Hz) represents the current frequency, and p represents the number of poles. The rotational speed of the electric motor is determined by the frequency of the AC power supply. For example, the rotational speed of an electric motor having two poles is 60 times the power supply frequency, the rotational speed of an electric motor having four poles is 30 times the power supply frequency, and the rotational speed of an electric motor having six poles is 20 times the power supply frequency. As can be seen from the foregoing description, the electric motor having two poles has a higher rotational speed than the electric motors having a different number of poles do.

Here, the frequency f (Hz) of mains electricity is generally equal to 50 or 60. Suppose that, for example, mains electricity is supplied to the AC electric motor having two poles and having the highest rotational speed. In this case, if the current frequency f is equal to 50, the rotational speed n is equal to 3000, and if the current frequency f is equal to 60, the rotational speed n is equal to 3600. In this embodiment, the speed adjuster (19) is provided to allow the rotational speed of the electric motor (15) at rated output to be higher than if the mains electricity is applied to the electric motor (15) as it is.

A known screw compressor that has its screw rotor (30) rotated at an angle greater than 180° to perform a stroke from the start of compression to completion of discharge has not allowed the rotational speed of the screw rotor (30) to be higher than the rotational speed of the electric motor (15). In other words, control itself has not been performed to allow the rotational speed of the screw rotor (30) to be different from the rotational speed of the electric motor (15). In this embodiment, rotating the screw rotor (30) at a rotational speed higher than 3000 (r/min) under a frequency f of 50 and at a rotational speed higher than 3600 (r/min) under a frequency f of 60 allows the rotational speed of the screw rotor (30) to be higher than if mains electricity is supplied to the electric motor (15) having two poles.

Next, the reason why the rotational speed is determined as described above will be described.

Figure 9:
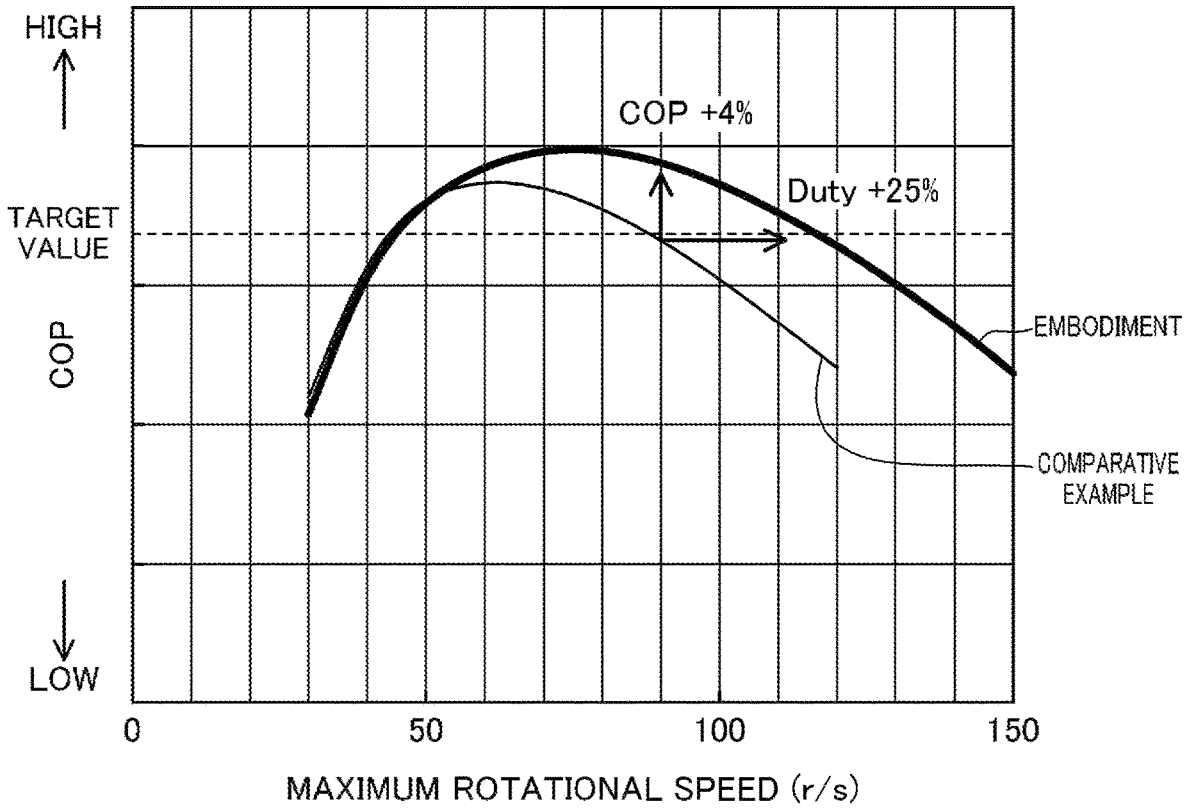
FIG. 9 is a graph showing the relationship between a maximum rotational speed at rated load and the COP.
Figure 10:
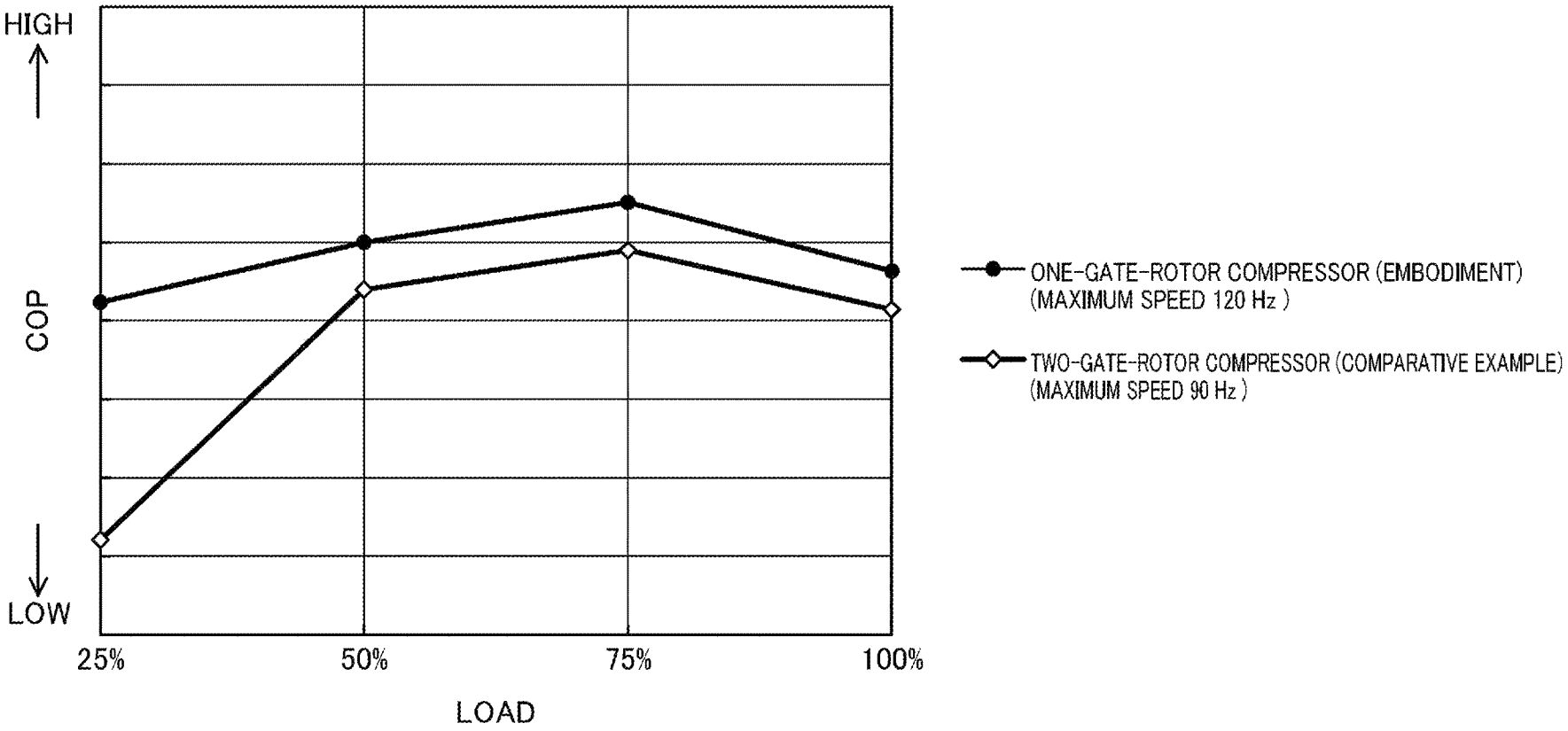
FIG. 10 is a graph showing the relationship between the load of the compressor and the COP.

FIG. 9 is a graph showing the relationship between a maximum rotational speed at rated load and the coefficient of performance (COP) of each of the screw compressor of this embodiment and a screw compressor of a comparative example. FIG. 10 is a graph showing the relationship between the load and COP of each of the screw compressors of this embodiment and the comparative example. The screw compressor of this embodiment includes one gate rotor (hereinafter referred to as "one gate"), and the screw compressor of the comparative example includes two gate rotors (hereinafter referred to as "two gates"). The screw compressor of this embodiment includes the screw rotor with three screw grooves and the gate rotor with ten gates. The screw compressor of the comparative example includes a screw rotor with six screw grooves, and a gate rotors each with eleven gates. The screw compressors of this embodiment and the comparative example have the same performance (displacement).

FIG. 9 shows that the screw compressor of this embodiment having a higher maximum rotational speed than the screw compressor of the comparative example has its COP increased. This is because the one-gate screw compressor undergoes a longer compression stroke, and has a lower discharge flow rate and lower leakage loss or lower pressure loss during high-speed rotation, than the two-gate screw compressor does.

To achieve the target value of the COP shown in FIG. 9 (which is determined based on the ratio between the ideal COP and the actual COP), the rotational speed is about 90 (r/s) in the comparative example and about 120 (r/s) in this embodiment. In this embodiment, the COP is about 4% higher, and the duty (the volume of discharge per unit time) is about 25% higher, than in the comparative example.

Next, how the COP of each of the screw compressors of this embodiment and the comparative example varies between at maximum load and at partial load will be described with reference to FIG. 10. The maximum rotational speed of the screw compressor of this embodiment at 100% load (at rated output) is determined to be 120 (r/s), based on FIG. 9. The maximum rotational speed of the screw compressor of the comparative example at 100% load is determined to be 90 (r/s), based on FIG. 9.

As shown in FIG. 10, even if the load applied to the screw compressor (1) of this embodiment varies among 100%, 75%, 50%, and 25%, the COP does not vary greatly. In contrast, in particular, if the load applied to the screw compressor of the comparative example varies to a low load of 25%, the COP decreases sharply. The reason for this may be that the screw compressor of the comparative example rotates at lower speed, and causes higher leakage loss, than the screw compressor (1) of this embodiment.

FIG. 9 shows that if the maximum rotational speed is higher than 60 (r/s), such high-speed rotation allows the COP to be higher than that of the comparative example. Thus, in one preferred embodiment, the maximum rotational speed of the screw compressor (1) of the present disclosure at 100% load is higher than 60 (r/s). In other words, the rotational speed n of the screw compressor (1) of the present disclosure at 100% load is set to be higher than 3000 (r/min) with consideration given to a case where the frequency f (Hz) of the mains electricity is equal to 50. If consideration is given to a case where the frequency f (Hz) is equal to 60, the rotational speed n is set to be higher than 3600 (r/min) in one preferred embodiment.

Operation

Next, it will be described how the screw compressor (1) operates.

In the screw compressor (1), upon actuation of the electric motor (15), the screw rotor (30) rotates in conjunction with the rotation of the drive shaft (21). The gate rotor (40) also rotates in conjunction with the rotation of the screw rotor (30), thereby causing the compression mechanism (20) to repeatedly perform one cycle of operation including a suction stroke, a compression stroke, and a discharge stroke.

In the compression mechanism (20), the rotation of the screw rotor (30) causes the screw grooves (31) and the gates (41) to move relative to each other. This causes the volume of the fluid chamber (23) of the screw compressor (1) to increase and then decrease.

While the volume of the fluid chamber (23) is increasing, the low-pressure gas refrigerant in the low-pressure chamber (11) is sucked into the fluid chamber (23) through the suction port (the suction stroke). If the rotation of the screw rotor (30) is advanced, the gates (41) of the gate rotor (40) define the compression chamber (23) such that the compression chamber (23) is separated from the low-pressure chamber. At that time, an action for increasing the volume of the compression chamber (23) ends, and an action for decreasing the volume is started. While the volume of the compression chamber (23) is decreasing, the sucked refrigerant is compressed (the compression stroke). Further rotation of the screw rotor (30) allows the compression chamber (23) to move. As a result, a discharge-side end of the compression chamber (23) communicates with the discharge port. If the discharge-side end of the compression chamber (23) opens to communicate with the discharge port, a high-pressure gas refrigerant is discharged from the compression chamber (23) to the high-pressure chamber (12) (the discharge stroke).

Adjusting the position of the slide valve (52) of the valve adjusting mechanism (50) allows the opening area of the opening (the discharge port) (51) serving as the discharge port formed on the cylindrical wall (25) of the casing (10) to change. This change in area triggers a change in the ratio of the discharge volume to the suction volume to adjust the internal volume ratio of the compression mechanism (20).

In this embodiment, the position of the slide valve (52) is controlled to optimize the discharge timing in accordance with the operating state. Thus, the refrigerant having a pressure suitable for the operating state is discharged from the screw compressor (1) to the refrigerant circuit (5). This improves the operating efficiency of the refrigerant circuit.

Advantages of Embodiment

The screw compressor of this embodiment is the screw compressor (1) with the one gate rotor. The screw compressor (1) includes the screw rotor (30) and the gate rotor (40). The screw rotor (30) has the outer peripheral surface with the screw grooves (31), and is rotated. The gate rotor (40) has the gates (41) serving as teeth. The ratio T/S of the teeth number T to the total number S of the screw grooves (31) is greater than or equal to 2.5. The gate rotor (40) meshes with the screw rotor (30). Rotation of the screw rotor (30) at an angle greater than 180° allows the screw compressor (1) to perform a stroke from the start of compression to completion of discharge. This screw compressor includes the speed adjuster (19) configured to adjust the rotational speed of the screw rotor (30).

A known screw compressor with one gate rotor includes an electric motor rotating the screw rotor at a fixed rotational speed. The capacity of the screw compressor (the displacement per unit time) is controlled by unloading such that a portion of a working fluid (a refrigerant) that is being compressed is returned to the suction side of the screw compressor. However, the unloading control may cause relatively high compression loss while the refrigerant is returned from the compression chamber to the suction side.

In this embodiment, the screw compressor (1) is a so-called one-gate-rotor compressor, which has a lower pressure loss than a two-gate-rotor compressor. This allows the maximum rotational speed of the screw rotor (30) to be higher than that of the two-gate-rotor compressor. In this embodiment, the speed adjuster (19) is provided to increase the maximum rotational speed. This allows the one-gate-rotor screw compressor (1) to be driven at a variable speed to rotate at high speed. This can reduce leakage loss while advantage is taken of low discharge pressure loss.

In the known screw compressor performing unloading control, a change in the position of the slide valve during unloading triggers a change in the discharge timing. Such a change in the discharge timing causes over-compression or lack of compression. This reduces the operating efficiency of the compressor.

In this embodiment, the operating capacity can be controlled by the rotational speed of the screw rotor (30). This makes it difficult to cause over-compression and lack of compression, thus substantially preventing the operating efficiency from decreasing.

In this embodiment, the number of the screw grooves (31) is three, and the teeth number of the gates (41) is ten. A great number of screw grooves (31) increase the rate of change in the volume of the refrigerant, resulting in an increase in the discharge flow rate. This increases the pressure loss and operating sound. However, in this embodiment, the discharge flow rate is reduced, and the pressure loss and operating sound are thus also reduced.

In this embodiment, the maximum rotational speed of the screw rotor (30) at rated output is set to be higher than 3000 (r/min). In other words, in this embodiment, if the frequency f of the AC power supply is equal to 50 (Hz), the maximum rotational speed of the screw rotor (30) at rated output is set to be higher than the rotational speed obtained if the voltage of the power supply is applied to the electric motor with two poles. In the known screw compressor (1) with one gate rotor, the rotational speed of the electric motor determined based on the frequency of the AC power supply is not adjusted. This makes it difficult to reduce leakage loss. In contrast, in this embodiment, the screw rotor (30) is rotated at a higher speed than in the known art, thereby reducing the amount of the refrigerant leaking per rotation of the screw rotor (30). This can reduce the leakage loss. This allows the COP to be higher than that of the known screw compressor.

Increasing the maximum rotational speed can increase the displacement even if the same screw rotor (30) or the same gate rotor (40) is used. Consequently, the cost of the compressor per unit performance can be reduced.

Figures 11A, 11B:
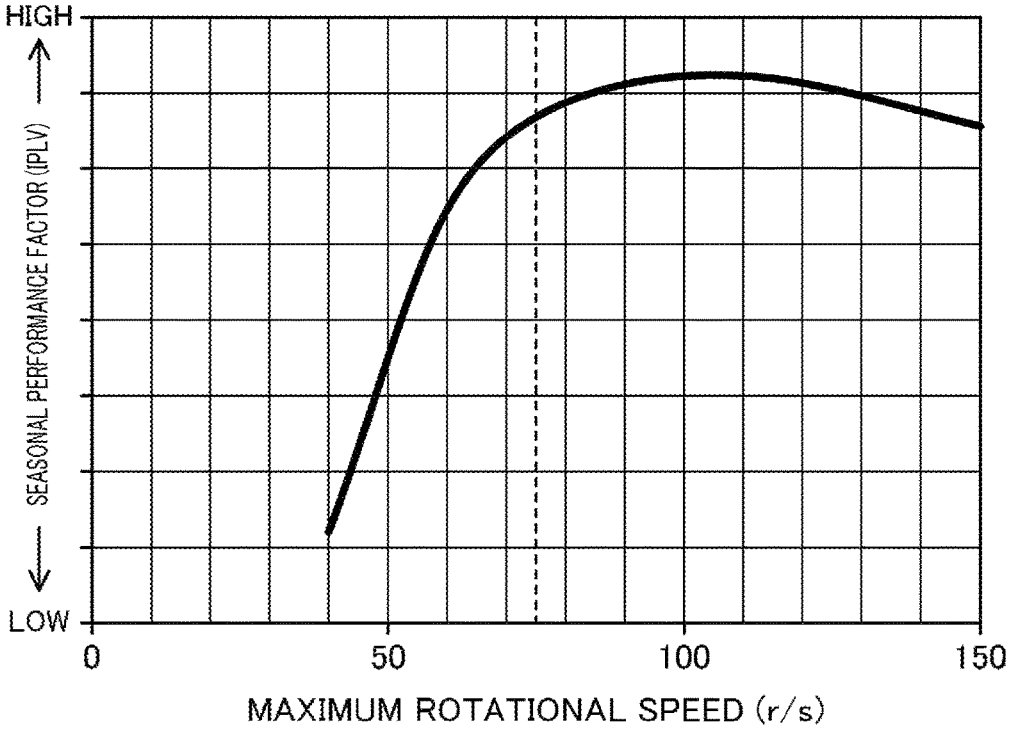
FIG. 11A is a graph showing the relationship between the maximum rotational speed at rated load and the seasonal performance factor.
FIG. 11B is a table showing numerical rotational speeds at partial load under different maximum rotational speeds at 100% load.

In this embodiment, the maximum rotational speed of the screw rotor (30) at rated output is set to be higher than 4500 (r/min). As shown in the graph of FIG. 11A, if the maximum rotational speed of the screw rotor (30) is lower than or equal to 4500 (r/min), the seasonal performance factor decreases significantly. On the other hand, if the maximum rotational speed of the screw rotor (30) at rated output is higher than 4500 (r/min), the seasonal coefficient of performance is stabilized.

In this embodiment, if a refrigerant which has a lower density and which is less likely to demonstrate its performance, than the refrigerant HFC-134a is used, rotating the screw compressor of the present disclosure at high speed substantially prevents the performance from decreasing, while advantage is taken of low pressure loss during discharge of the refrigerant.

Other Embodiments

The foregoing embodiment may be modified as follows.

First Variation

For example, FIG. 11A is a graph showing the relationship between a maximum rotational speed at 100% load and the seasonal performance factor. FIG. 11B is a table showing numerical maximum rotational speeds at 75% load, at 50% load, and at 25% load under different maximum rotational speeds (r/s) of 150, 120, 90, and 60 at 100% load. A formula defining the seasonal coefficient of performance is indicated below the graph of FIG. 11A.

The seasonal coefficient of performance as used herein includes an integrated part load value (IPLV) defined by the Air Conditioning, Heating and Refrigeration Institute. The "seasonal coefficient of performance" is an annual COP determined by weights respectively assigned to the COPs under loads applied during a period during which the load is high, a period during which the load is low, and a period during which the load is medium in a year.

The IPLV is determined based on the following formula:

$$IPLV=0.01A+0.42B+0.45C+0.12D$$

where A represents the COP at rated load (a load factor of 100%), B represents the COP at a load factor of 75%, C represents the COP at a load factor of 50%, and D represents the COP at a load factor of 25%. This formula means that targets each having an IPLV to be determined may operate at a load factor of 50% for an average of 45% of the annual operating time, at a load factor of 75% for an average of 42% of the annual operating time, at a load factor of 25% for an average of 12% of the annual operating time, and at a load factor of 100% for an average of 1% of the annual operating time.

As can be seen from FIG. 11A, if the maximum rotational speed of the screw rotor (30) is higher than 75 (r/s) (4500 (r/min)), the seasonal performance factor varies slightly. Thus, it is recommended that in the screw compressor of the present disclosure, the maximum rotational speed at rated output be higher than 4500 (r/min).

Second Variation

In the foregoing embodiment, the total number S of the screw grooves is three, and the teeth number T of the gates of the gate rotor is 10. However, the total number S of the screw grooves may be, for example, three or four, and the teeth number T of the gates of the gate rotor may range from 10 to 15.

Third Variation

In the foregoing embodiment, the slide valve is provided to adjust the internal volume ratio, and is controlled to optimize the discharge timing in accordance with the operating state. However, the slide valve does not necessarily have to be controlled in this manner. Even in this case, the compression loss in the screw compressor can be reduced.

Fourth Variation

In the foregoing embodiment, the refrigerant R1234ze is used as the refrigerant serving as the working fluid. However, a refrigerant for use in the screw compressor of this embodiment does not necessarily have to be the foregoing type of refrigerant. For example, any one of the refrigerants R152a, R515A, R515B, and R450A may be used as the refrigerant serving as the working fluid. Just like the refrigerant R1234ze, the refrigerants R152a, R515A, R515B, and R450A each have a lower density than the refrigerant HFC-134a does.

In addition, the screw compressor of this embodiment can rotate at high speed to demonstrate its performance. Thus, a refrigerant having a lower density and lower performance per unit volume than the refrigerant HFC-134a is suitably used. However, such a refrigerant having a lower density than the refrigerant HFC-134a is merely an example of a refrigerant for use in the screw compressor of this embodiment.

Fifth Variation

In the foregoing embodiment, the inverter circuit has been described as the speed adjuster (19). However, a transmission including gear trains and other components, for example, may be interposed between an output shaft of the electric motor (15) and the screw rotor (30), and may be used as the speed adjuster (19). As can be seen, the inverter for use in a drive circuit of the electric motor (15) is merely an example of the speed adjuster (19).

While the embodiments and variations thereof have been described above, it will be understood that various changes in form and details may be made without departing from the spirit and scope of the claims. The foregoing embodiments and variations thereof may be combined and replaced with each other without deteriorating the intended functions of the present disclosure.

As can be seen from the foregoing description, the present disclosure is useful for a screw compressor.

The invention claimed is:

1. A screw compressor comprising:

a screw rotor having an outer peripheral surface with a plurality of screw grooves, the screw rotor being configured to be rotated; and a gate rotor having a plurality of teeth, a ratio T/S of a number T of the teeth to a total number S of the screw grooves being greater than or equal to 2.5, and the gate rotor meshing with the screw rotor; and a speed adjuster configured to adjust a rotational speed of the screw rotor, rotation of the screw rotor at an angle greater than 180° allowing the screw compressor to perform a stroke from start of compression to completion of discharge.

2. The screw compressor according to claim 1, further comprising:

an electric motor configured to rotate the screw rotor, the speed adjuster being configured to allow the rotational speed of the screw rotor to be higher than if a power supply voltage at a rated frequency is applied to the electric motor.

3. The screw compressor according to claim 2, wherein the total number S of the screw grooves is three or four, and the number T of the teeth of the gate rotor is 10 to 15.

4. The screw compressor according to claim 2, wherein a maximum rotational speed of the screw rotor at rated output is higher than 3000 rotations per minute.

5. A refrigeration apparatus according to claim 2, wherein a working fluid is a refrigerant circulating through a refrigerant circuit, and the refrigerant has a lower density than an HFC-134a refrigerant.

6. The refrigeration apparatus according to claim 5, wherein the refrigerant is any one of R1234ze, R152a, R515A, R515B, or R450A.

7. The refrigeration apparatus according to claim 6, wherein the refrigerant is any one of R1234ze, R152a, R515A, R515B, or R450A.

8. The screw compressor according to claim 1, wherein the total number S of the screw grooves is three or four, and the number T of the teeth of the gate rotor is 10 to 15.

9. The screw compressor according to claim 8, wherein a maximum rotational speed of the screw rotor at rated output is higher than 3000 rotations per minute.

10. A refrigeration apparatus according to claim 8, wherein a working fluid is a refrigerant circulating through a refrigerant circuit, and the refrigerant has a lower density than an HFC-134a refrigerant.

11. The refrigeration apparatus according to claim 10, wherein the refrigerant is any one of R1234ze, R152a, R515A, R515B, or R450A.

12. The screw compressor according to claim 1, wherein a maximum rotational speed of the screw rotor at rated output is higher than 3000 rotations per minute.

13. The screw compressor according to claim 12, wherein the maximum rotational speed of the screw rotor at rated output is higher than 4500 rotations per minute.

14. A refrigeration apparatus according to claim 12, wherein a working fluid is a refrigerant circulating through a refrigerant circuit, and the refrigerant has a lower density than an HFC-134a refrigerant.

15. The refrigeration apparatus according to claim 14, wherein the refrigerant is any one of R1234ze, R152a, R515A, R515B, or R450A.

16. A refrigeration apparatus according to claim 1, wherein a working fluid is a refrigerant circulating through a refrigerant circuit, and the refrigerant has a lower density than an HFC-134a refrigerant.

17. The refrigeration apparatus according to claim 16, wherein the refrigerant is any one of R1234ze, R152a, R515A, R515B, or R450A.

* * * * *